US008109392B2

(12) United States Patent
Byrne et al.

(10) Patent No.: US 8,109,392 B2
(45) Date of Patent: Feb. 7, 2012

(54) APPARATUS AND METHOD FOR REMOVING IMPURITIES IN CRUSHED RECYCLED MATERIAL

(75) Inventors: Philip Andrew Byrne, Leonay (AU); John Richard Gooding, Lisarow (AU)

(73) Assignee: Airstream Recycling Forces Pty Ltd, Leonay, NSW (AU)

( * ) Notice: Subject to any disclaimer, the term of this patent is extended or adjusted under 35 U.S.C. 154(b) by 580 days.

(21) Appl. No.: 11/990,879

(22) PCT Filed: Jul. 5, 2006

(86) PCT No.: PCT/AU2006/000947

§ 371 (c)(1),
(2), (4) Date: Mar. 6, 2009

(87) PCT Pub. No.: WO2007/025324

PCT Pub. Date: Mar. 8, 2007

(65) Prior Publication Data

US 2011/0056872 A1 Mar. 10, 2011

(30) Foreign Application Priority Data

Aug. 29, 2005 (AU) ..... 2005904700

(51) Int. Cl.
*B07B 9/00* (2006.01)

(52) U.S. Cl. ..... 209/34; 209/35; 209/139.1; 209/317

(58) Field of Classification Search ..... 209/30, 209/31, 34, 35, 136, 137, 138, 139.1, 154, 209/311–313, 315–318; 241/68, 75, 79
See application file for complete search history.

(56) References Cited

U.S. PATENT DOCUMENTS

| | | | | |
|---|---|---|---|---|
| 603,448 | A * | 5/1898 | Lewis | 209/23 |
| 2,200,472 | A | 5/1940 | Erdmann | |
| 2,203,821 | A | 6/1940 | Hinchman | |
| 3,622,089 | A * | 11/1971 | Quinn | 241/75 |
| 3,899,139 | A * | 8/1975 | Okada et al. | 241/68 |
| 3,909,873 | A | 10/1975 | Minasov et al. | |
| 4,631,124 | A | 12/1986 | Paulson | |
| 5,344,025 | A | 9/1994 | Tyler et al. | |
| 5,992,774 | A * | 11/1999 | Oh | 241/20 |
| 7,478,771 | B2 * | 1/2009 | Whittaker | 241/29 |
| 2010/0159247 | A1 * | 6/2010 | Kaya et al. | 428/402 |

FOREIGN PATENT DOCUMENTS

| | | |
|---|---|---|
| DE | 31 26 585 A1 | 1/1983 |
| GB | 227528 | 1/1925 |
| GB | 1419337 | 12/1975 |
| JP | 2001334397 | 12/2001 |

* cited by examiner

*Primary Examiner* — Joseph C Rodriguez
(74) *Attorney, Agent, or Firm* — Kilpatrick Townsend & Stockton LLP

(57) ABSTRACT

A concrete processing apparatus (10) including at least one chute (14) along which crushed concrete and impurities is to pass. The chute (14) is downwardly inclined and has an air outlet to which air is delivered from a blower (29). An air stream issuing from the air outlet is directed across the interior of the chute (14) to deliver impurities to an impurities outlet (23).

15 Claims, 5 Drawing Sheets

APPARATUS AND METHOD FOR REMOVING IMPURITIES IN CRUSHED RECYCLED MATERIAL

CROSS-REFERENCES TO RELATED APPLICATIONS

This application is a U.S. National Phase and claims the benefit of PCT Patent Application No. PCT/AU2006/000947, filed Jul. 5, 2006, which claims the priority of Australian Patent Application No. 2005904700, filed Aug. 29, 2005, the disclosures of which are incorporated herein by reference.

FIELD OF THE INVENTION

The present invention relates to an apparatus and method for removing impurities in crushed material such as concrete to be recycled.

BACKGROUND OF THE INVENTION

When a concrete building is demolished, the demolished concrete is transported in small pieces by trucks to a concrete recycling facility. The concrete material is crushed and transferred to a conveyor where magnets are used to remove metallic objects from the crushed concrete. Large non-metallic material is removed manually. After these processes, what is typically left is concrete crushed to about 80 mm minus, meaning concrete particles having a dimension of 80 mm or less. The crushed concrete is separated using multiple deck grated screens into different sizes of 80 mm plus (>80 mm), 20 mm (having a dimension of 80-20 mm), 10 mm (20-10 mm) and minus 10 mm ("dust"). Material which is 80 mm plus is returned by conveyor to a secondary crusher to be crushed again and then returned to the screens for sizing.

Generally, recycled 80 mm minus, 20 mm minus and dust concrete can be used again in the building of new buildings or for other purposes. The crushed concrete however is contaminated with large amounts of foreign material such as timber, plastics, light aluminum, wire, asbestos, and other material.

Numerous apparatus and methods for removing impurities from crushed recycled concrete have been proposed. However, the current methods are either not effective or too expensive to be commercially viable.

SUMMARY OF THE INVENTION

It is an object of the present invention to substantially overcome or at least ameliorate the prior art disadvantages or at least provide a useful alternative.

There is disclosed herein a processing apparatus to remove impurities from crushed material that is to be recycled, the apparatus including:

a chute having an interior along which crushed material having impurities is to pass under the influence of gravity, the chute having an impurities outlet disposed on a first side of the chute, and an air outlet disposed on a side opposite the impurities outlet so that an air stream issuing from the air outlet passes across the interior towards the first side; and a blower means connected to the air outlet to deliver air thereto so that the stream passes through the crushed material passing along the chute to engage the impurities to deliver the impurities to the impurities outlet while permitting the crushed material to continue along the chute.

Preferably, the chute is inclined to the horizontal by the acute angle so that the first side is above the opposite side.

Preferably, the chute has a transverse width, with the air outlet extending across the width.

Preferably, the apparatus further includes speed retarding means to retard speed of the crushed concrete passing along the interior, the retarding means being located upstream of the air outlet.

Preferably, the apparatus further includes a bar extending transversely across the interior adjacent the opposite wall at a position upstream of the air outlet.

Preferably, the air outlet is configured so that the air stream is evenly distributed across the chute.

Preferably, the apparatus further includes means to adjust the flow rate of air delivered to the air outlet.

Preferably, the apparatus is an apparatus to process crushed concrete.

There is also disclosed herein an assembly including a plurality of concrete processing apparatuses, each apparatus being a concrete processing apparatus as described above.

There is further disclosed herein, in combination, the above assembly, and a sieve apparatus, the sieve apparatus being adapted to provide crushed concrete in several streams, each stream having crushed concrete of a desired size, with each stream being associated with a respective one of the processing apparatuses.

BRIEF DESCRIPTION OF THE DRAWINGS

Preferred embodiments of the present invention will now be described by way of examples only, with reference to the accompanying drawings, wherein.

DESCRIPTION OF THE PREFERRED EMBODIMENTS

Figure 1:
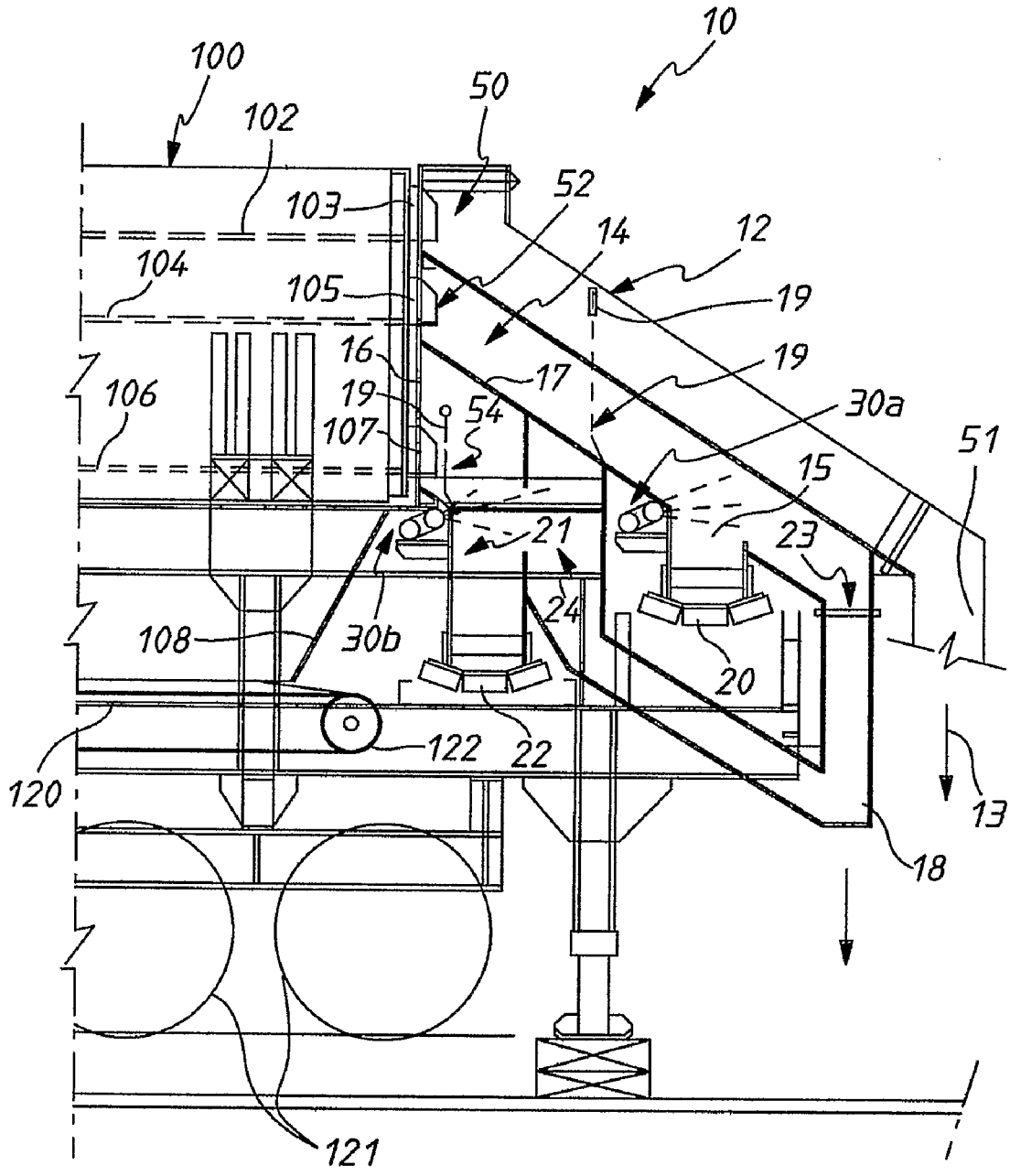
FIG. 1 shows a schematic cross-sectional side view of an apparatus to remove impurities in crushed concrete.

FIG. 1 shows an apparatus 10 according to a preferred embodiment of the present invention. The apparatus 10 is shown attached to a triple deck screen apparatus 100 and mounted on top of a flatbed trailer 120 having wheels 121.

The screen apparatus 100 includes an upper first screen 102, a middle second screen 104, a lower third screen 106 and a chute 108 below the third screen 106. The screens 102, 104 and 106 are horizontal, of similar dimensions and placed one on top of the other. The screen 102 has an outlet 103, the second screen 104 has an outlet 105, and the third screen 106 has an outlet 107. A dust conveyor 122 is mounted onto the trailer 120 below the chute 108.

The screen 100 can be any of the known multiple deck screens commercially available, such as the Cedar Rapids Triple Deck Screen.

The apparatus 10 includes an upper first chute 12, a middle second chute 14 and a lower third chute 16, each providing a duct along which the crushed concrete is to flow under the influence of gravity. The chutes 12, 14 and 16 are as wide as the screens 102, 104 and 106. The first chute 12 is angled downwardly and includes an inlet 50 and an outlet 51 below and downstream from the inlet 50. The first chute inlet 50 is connected to the first screen outlet 103.

The second chute 14 is also angled downwardly, and includes an inlet 52, a first outlet 15 below and downstream from the inlet 52, and a second outlet 23. The second chute inlet 52 is connected to the second screen outlet 105. A conveyor 20 is arranged below the second chute outlet 15, and the lower outlet 23 connects to an outlet 18.

The third chute 16 includes an inlet 54, a first outlet 21 below and downstream from the inlet 54, and a second lower outlet 24. The third chute inlet 54 is connected to the third screen outlet 107. A conveyor 22 is arranged below the second chute outlet 21, and the lower outlet 24 connects to the outlet 18.

The second chute 14 includes a blower outlet 30*a* arranged immediately upstream of the outlet 15 thereof, and the third chute 16 includes a blower outlet 30*b* arranged immediately upstream of the outlet 21 thereof. The blower outlets 30*a* and 30*b* will be further described below. Arranged upstream of the blower outlets 30*a* and 30*b* are retardation curtains 19.

Figure 2:
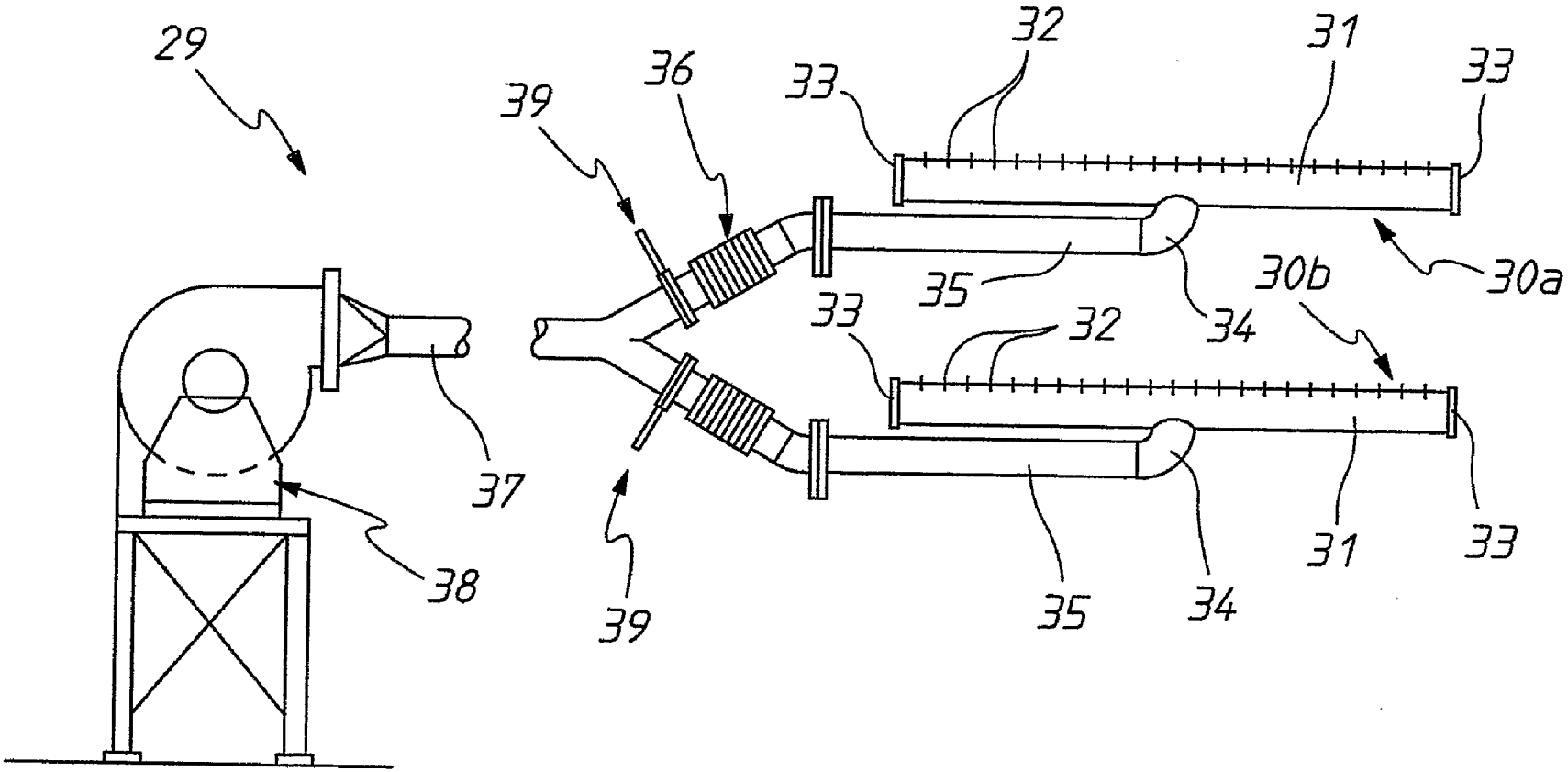
FIG. 2 shows a blower assembly for the apparatus of FIG. 1.

FIG. 2 shows a blower assembly 29 for the apparatus 10. The blower assembly 29 includes a blower machine 38 having an outlet connected to a first duct 37. The first duct 37 includes a split end outlet, each outlet being connected to second ducts 36, which are respectively connected to third ducts 35. The third ducts 35 are connected by elbow pipes 34 to mid-portions of blower pipes 31. The blower outlets 30*a* and 30*b* shown in FIG. 1 consist of the third ducts 35, elbow pipes 34 and the blower pipes 31. Each blower pipe 31 includes closed end plates 33 at ends thereof and a number of spaced holes 32 formed along its length. The size of the holes 32 may vary depending on the air pressure required. The length of each blower pipe 31 extends the width of the respective second chute 14 or third chute 16.

The blower machine 38 is operable to supply high pressure air to the blower pipes 31, exiting same via the spaced holes 32. Slidable valves 39 are arranged at the outlets of the first duct 37, which are slidable from a fully open position (at which the first duct outlet is fully open) to a substantially closed position (at which the first duct outlet is substantially closed) such that the amount of air exiting the pipes 31 can be altered as desired.

Figure 3:
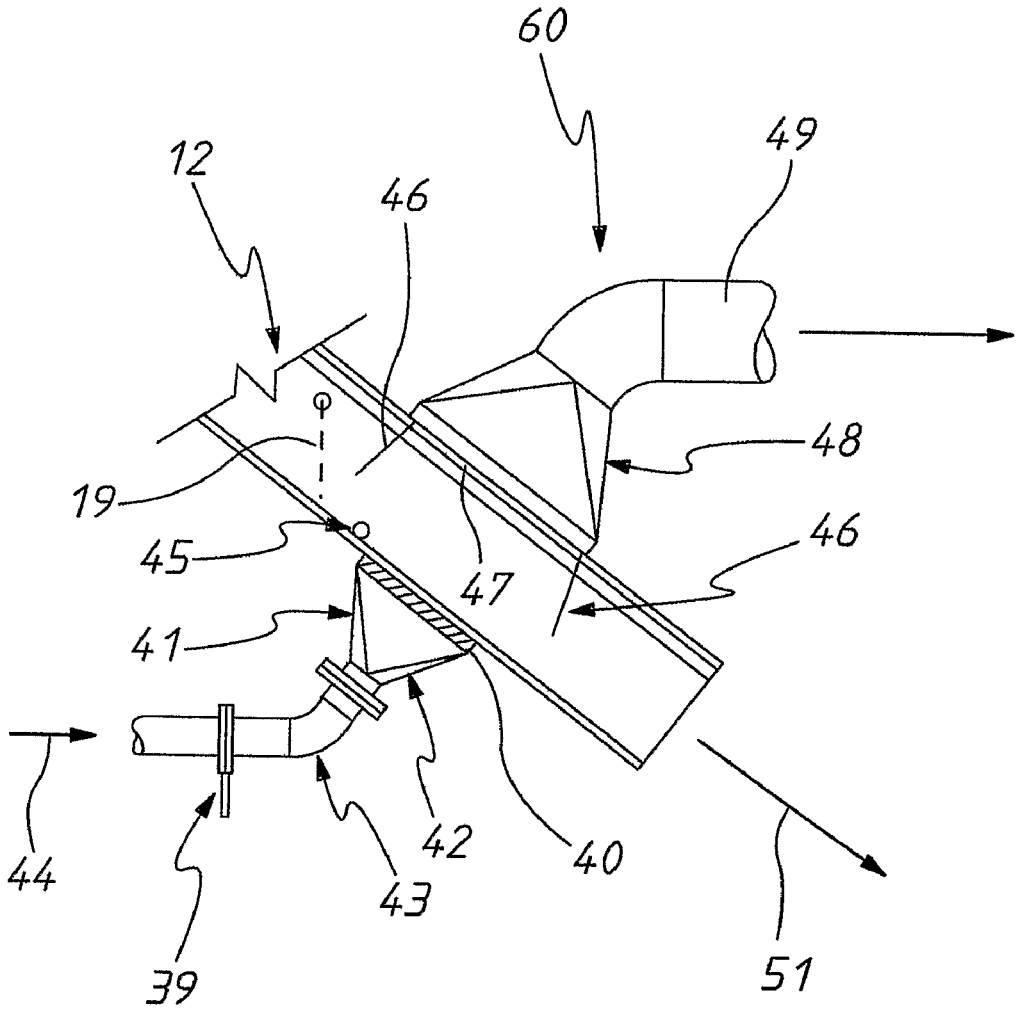
FIG. 3 shows a blower outlet assembly for the first chute of the apparatus of FIG. 1.

FIG. 3 shows a blower outlet assembly 60 for the first chute 12 of the apparatus 10. The assembly 60 is an optional feature of the apparatus 10 and is not shown in FIG. 1. The assembly 60 can be arranged below and downstream of the retardation curtain 19 of the first chute 12. The blower outlet assembly 60 includes a pipe 43 connected to a transition duct 42 which is connected to an opening 40 at the bottom wall of the chute 12. A mesh panel 41 extends across the opening 40. A bar 45 is disposed across the chute 12 immediately upstream and above the opening 40. Opposite to the opening 40, a reject material outlet opening 47 is formed in the upper wall of the chute 12. Baffle plates 46 extend from the opening 47 wider than the opening 40. Connected to the outlet 47 is a hood 48 which leads to a reject material duct 49. The first chute 12 may also contain a blower pipe (the same as blower pipes 31). In other applications, all chutes may have a blower installed and the capacity of blowers may vary.

The pipe duct 43 receives high pressure air from the blower 38 as indicated by arrow 44. Arranged in the pipe 43 is a slidable valve 39 for altering the volume of air exiting the opening 40.

The use of the apparatus 10 will now be described.

Referring to FIG. 1, crushed concrete having impurities is poured onto the screen apparatus 100. The screens 102, 104 and 106 are moved in a known manner in order to separate the crushed concrete particles into separate sizes. The screen 102 is sized to allow particles having dimensions less than 80 mm to pass therethrough onto the second screen 104. Particles having a dimension greater than 80 mm are moved by the screen 102 onto its outlet 103. The screen 104 is sized to allow particles having dimensions less than 20 mm to pass therethrough onto the third screen 106. Particles which have a dimension greater than 20 mm (but less than 80 mm due to the first screen 102) are moved by the screen 104 onto its outlet 105. The third screen 106 allows particles having dimensions less than 10 mm to pass therethrough onto the chute 108 and conveyor 122. Particles having a dimension greater than 10 mm (but less than 20 mm due to the screen 104) are moved by the screen 106 onto its outlet 107. In other applications, the size of the screens may be different and the particle sizes of 80 mm, 20 mm and 10 mm are specific to this embodiment only.

The particles having dimensions less than 10 mm received by the conveyor 122 are collected. At the third screen outlet 107, the particles fall substantially as a sheet across the width of the screen 106 into the chute 16 and across the blower outlet 30*b*. The natural path for the particles will be toward the outlet 21. As mentioned above, the blower machine 38 forces high pressure air out through the blower outlets 30*a* and 30*b*. The outlet 30*b* thus blows high pressure air across and through the falling particles. The impurities within the crushed concrete which are lighter than the concrete, such as wood and plastics, are forced by the air stream into the second outlet 24, while the heavier crushed concrete falls through into the first outlet 21. The impurities are thus substantially removed from the crushed concrete. The crushed concrete is collected by the conveyor 22 and the impurities fall into the outlet 18.

At the second screen outlet 105, the particles also fall substantially as a sheet across the width of the screen 104 into the chute 14 and across the blower outlet 30*a*. The natural path for the particles will be toward the outlet 15. The outlet 30*a* blows high pressure air across and through the falling particles. The impurities within the crushed concrete lighter than the concrete are forced by the air stream into the second outlet 23 and into outlet 18, while the heavier crushed concrete falls through into the first outlet 15. The crushed concrete substantially free of impurities is collected by the conveyor 20.

At the first screen outlet 103, the particles also fall substantially as a sheet across the width of the screen 102 into the chute 12. If the apparatus 10 includes the blower outlet assembly 60, referring to FIG. 3, the particles fall along the bottom wall of the chute 12. The natural path for the particles will be toward the outlet 51. The falling particles strike the bar 45 at which the particles are "bounced" into mid-air. As the particles are suspended in mid-air within the chute 12, high pressure air from the duct 43 is forced through the suspended particles. The baffles 46 substantially ensure that the air stream from the outlet 40 is directed into the outlet 47. Impurities lighter than the crushed concrete are blown into the hood 48 and duct 49, allowing the heavier concrete material to fall into the chute outlet 51. The crushed concrete collected at the outlet 51 is sent to a crusher to be re-crushed and re-classified by the screen apparatus 100.

The apparatus 10 thus provides recycled 10 mm and 20 mm recycled concrete which is substantially free of impurities, or at the least having significantly fewer impurities than prior art apparatuses.

The sliding valves 39 in the ducts 37 and 43 allow a user to adjust the volume of air forced through the crushed particles to ensure that (1) the air pressure is sufficient to remove the impurities and (2) the air pressure is not excessive in that crushed concrete particles are also forced into the second outlets with the impurities.

The retardation curtains 19 substantially spread the particles in a thin sheet-like layer and slow the speed of the particles falling down the chutes prior to the blower outlets 30*a*, 30*b* and 40 for increased effectiveness of the apparatus 10. The operation of the screen apparatus 100 can also assist in ensuring that the volume of particle output therefrom is not excessive.

Air is forced out substantially evenly along the length of the pipes 31 of the outlets 30*a* and 30*b*. This increases the effectiveness of the apparatus 10. In the embodiment, the pipes 31 have a diameter of 114.3 mm and a thickness of 4.5 mm. The holes 32 are 10 mm in diameter and spaced 20 mm apart. The holes 32 are countersunk and de-burred on the inside. The outlet pipes 31 are axially rotated such that the holes 32 are at an angle of about 23° to the horizontal. This has been found to be the most effective angle for the apparatus 10.

The elbow pipes 34 are standard 90° elbows. The third ducts 35 are made from the same material as the pipes 31. The second duct 36 has a diameter of 127 mm and is made from flexible plastics material (e.g. PVC) having a concertina fold therein to reduce vibration in the duct 36. The first duct 37 is made from galvanized steel and has a diameter of 125 mm. The blower 38 in the embodiment is mounted on a free-standing support structure and has the capacity of blowing 2500 cfm of air at a pressure of 42" WC.

The chutes 12, 14 and 16 are downwardly inclined at an angle to suit the application.

Other materials that can be blown are bricks, tiles, pavers, masonry blocks, roof tiles and glass.

Although preferred embodiments of the present invention have been described, it will be apparent to skilled persons that modifications can be made to the above embodiments or that the present invention can be embodied in other forms.

Figure 6:
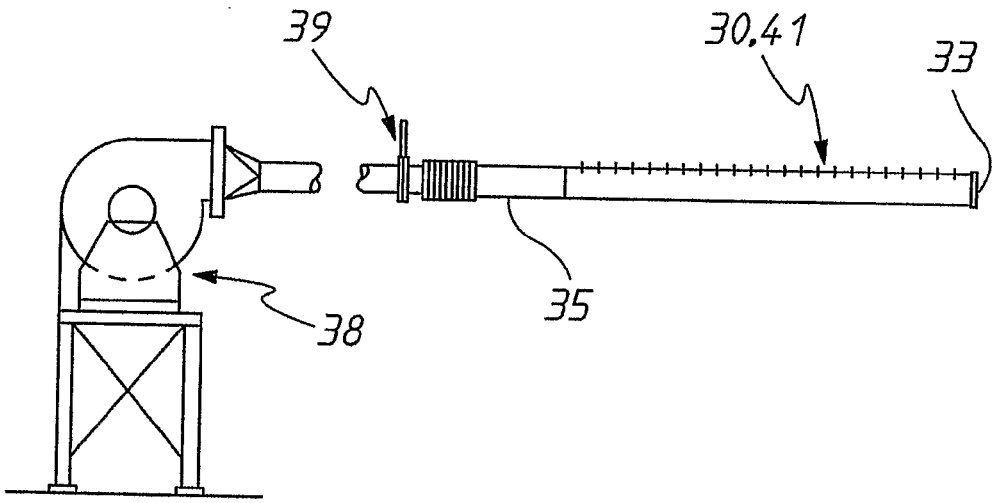
FIG. 6 is a schematic side elevation of a blower to be used with the apparatus of FIG. 4.

For example, instead of utilizing a single blower 38, multiple blowers can be used in the present invention, one for each outlet 30*a*, 30*b* or 41. An example of such a blower 38 is shown in FIG. 6. Also, the present invention can be installed in a permanent recycling facility, rather than on a trailer. In the blower assembly 29, it is also possible to simply connect the second duct 36 to an end of the pipes 31 and not use the third ducts 35 and elbow pipe 34. This arrangement can be used if there is insufficient space to insert the outlets 30*a* and 30*b* into the apparatus 10. Such an arrangement however is less preferred as it does not provide an even output of air along the length of the pipes 31.

Figure 4:
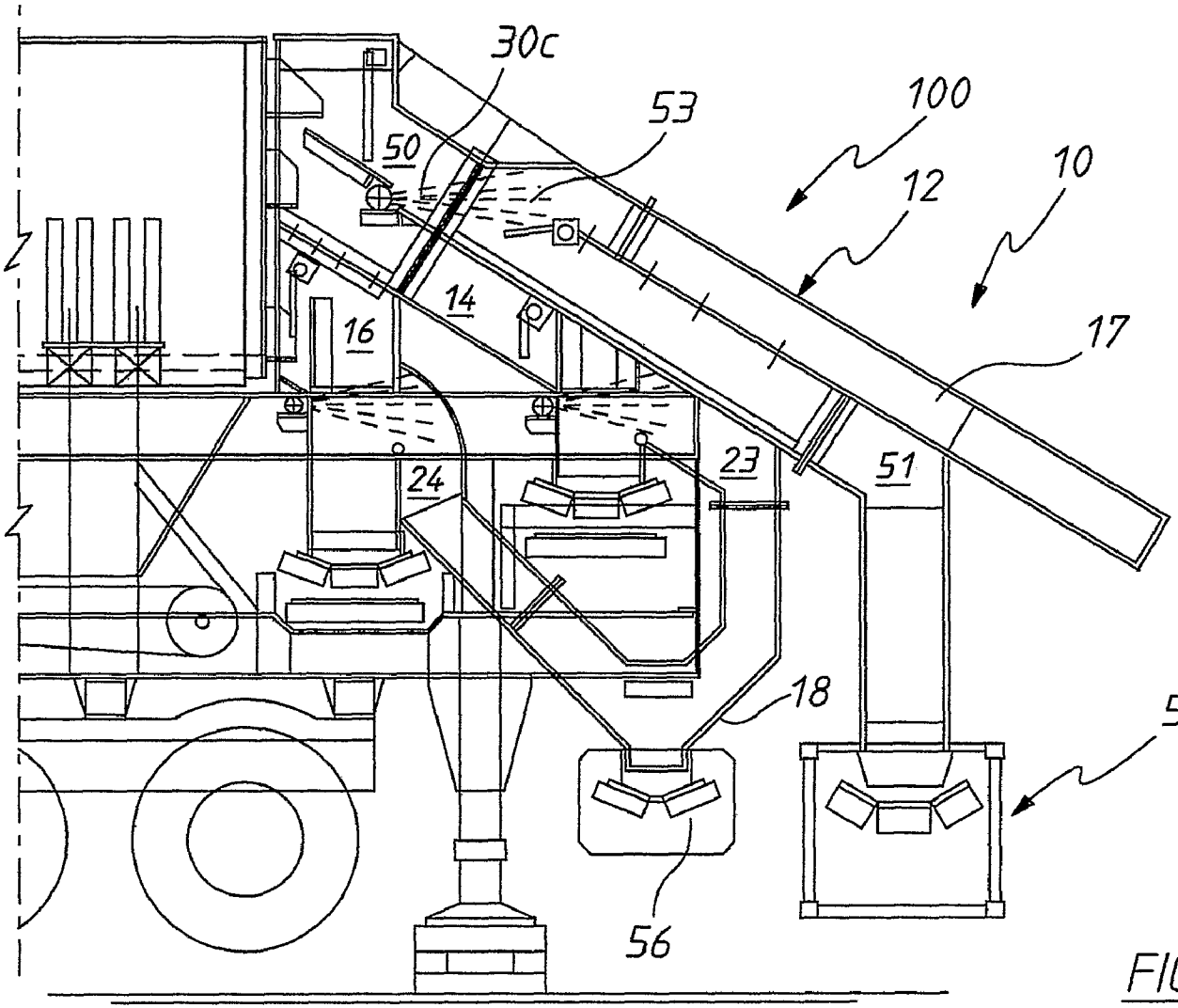
FIG. 4 is a schematic cross-section side view of a modification of the apparatus of FIG. 1.
Figure 5:
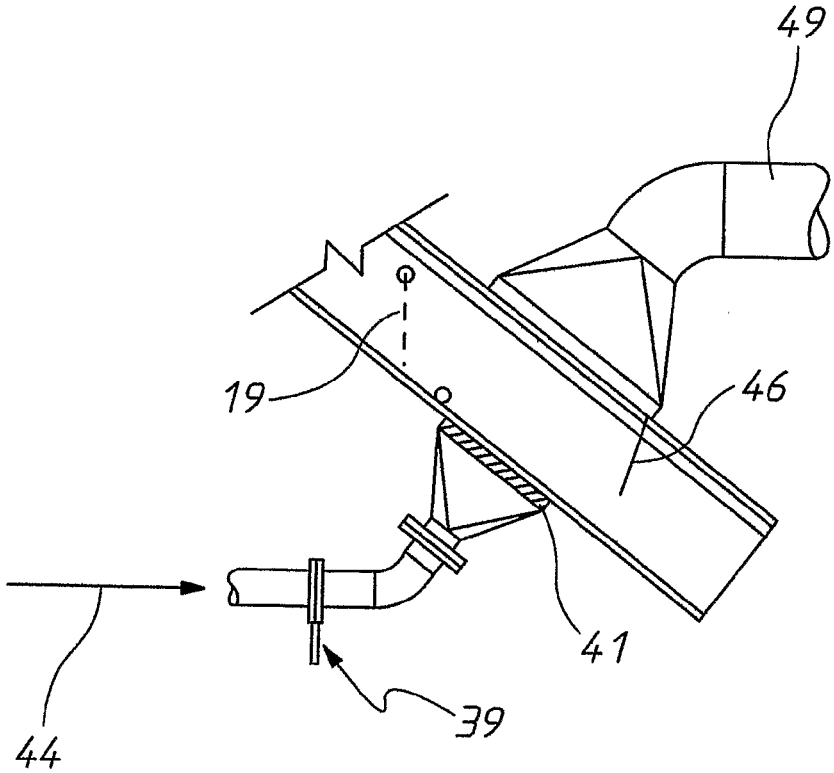
FIG. 5 is a schematic illustration of a blower assembly employed in the apparatus of FIG. 4.

In FIGS. 4 to 6 there is schematically depicted a modification of the apparatus 10. In this example, the upper chute 12 also includes the inlet 50 and the outlet 51; however intermediate thereof is an impurities outlet 53 on one side of the chute 12, while opposite the outlet 53 is a blower outlet 30*c*. The outlet 53 communicates with a chute 17 down which impurities are ducted.

The outlet 51 delivers crushed concrete to a conveyor 55, with the outlets 23 and 24 delivering impurities to a single conveyor 56.

In this embodiment each blower 38 delivers air to a single blower outlet 30. Also in this embodiment only a single baffle 46 is employed, that baffle 46 being downstream of the outlet 41. The same can be applied to the other prior outlets.

In the modification of the apparatus 10 as shown in FIGS. 3 and 5, the duct 49 is spaced from the duct 12, while in FIG. 4, the duct 49 is adjacent the duct 12.

In the above embodiments, the ducts 12, 14 and 16 are located so as to be vertically stacked, that is, the duct 14 above the duct 16, and the duct 12 above the duct 14.

The above embodiments are described with reference to processing crushed concrete. In that regard the above embodiments could be adapted to process the crushed materials to be recycled.

The claims defining the invention are as follows:

1. An assembly to remove lighter impurities from crushed heavier material that is to be recycled, the assembly comprising:

a first screen configured for the crushed material to be delivered thereto, said first screen having an outlet;

a second screen configured for the crushed material that has passed through the first screen to be delivered thereto, said second screen having an outlet;

a first chute positioned to receive the crushed material from said first screen outlet; and a second chute positioned to receive the crushed material from said second screen outlet;

wherein each chute comprises:

an interior configured for the crushed material to pass therethrough under the influence of gravity, an impurities outlet disposed on a first side of each chute, and an air outlet disposed on a side of each chute opposite said impurities outlet so that an air stream entering said interior from said air outlet passes across said interior towards said impurities outlet; and a blower connected to each air outlet to deliver air thereto so that said air stream passes through the crushed material passing along the associated chute to engage the impurities to deliver the impurities to the associated impurities outlet while permitting the crushed material to continue along said associated chute.

2. The assembly of claim 1, wherein at least one of the chutes is inclined to the horizontal by an acute angle so that said impurities outlet is above the associated air outlet.

3. The assembly of claim 2, wherein each chute has a transverse width, and each air outlet extends across the width of the associated chute.

4. The assembly of claim 2, wherein each chute includes a speed retarding means to retard speed of crushed material passing along the chute, each retarding means being located upstream of the associated air outlet.

5. The assembly of claim 2, wherein both chutes are inclined to the horizontal by an acute angle so that each impurities outlet is above the associated air outlet.

6. The assembly of claim 2, wherein one of the chutes is generally vertically oriented.

7. The assembly of claim 1, wherein each chute has a transverse width, and each air outlet extends across the width of the associated chute.

8. The assembly of claim 7, wherein each chute includes a speed retarding means to retard speed of crushed material passing along the chute, each retarding means being located upstream of the associated air outlet.

9. The assembly of claim 1, wherein each chute includes a speed retarding means to retard speed of the crushed material passing along the chute, each retarding means being located upstream of the associated air outlet.

10. The assembly of claim 9, wherein each air outlet provides an air stream issuing therefrom that is evenly distributed across the associated chute.

11. The assembly of claim 1, wherein each air outlet provides an air stream issuing therefrom that is evenly distributed across the associated chute.

12. The assembly of claim 1, further including means to adjust a flow rate of air delivered to each air outlet.

13. The assembly of claim 1, wherein at least one of the chutes comprises a first, generally inclined section upstream of the blower and a second, generally vertical section downstream of the blower configured for the crushed material to be delivered thereto, wherein the impurities outlet is generally level with the blower such that the air and impurities are blown across the generally vertical section to the impurities outlet.

14. The assembly of claim 1, wherein at least one of the chutes is generally inclined, wherein the blower is disposed on a bottom surface of the chute, and wherein the impurities outlet is disposed on a top surface of the chute.

15. An assembly to remove impurities from crushed material that is to be recycled, the assembly being configured to be used downstream of a crushed material sorter that sorts the material into at least two groups of different average particle sizes, the assembly comprising:

a first chute comprising:

a first inlet configured to receive first crushed material of a first average particle size;

a first interior configured for the first crushed material to pass therethrough under the influence of gravity;

a first crushed material outlet;

a first impurities outlet; and a first blower configured to engage first impurities and to transport the first impurities across the first crushed material outlet to the first impurities outlet; and a second chute comprising:

a second inlet configured to receive second crushed material of a second average particle size;

a second interior configured for the second crushed material to pass therethrough under the influence of gravity;

a second crushed material outlet;

a second impurities outlet; and a second blower configured to engage second impurities and to transport the second impurities across the second crushed material outlet to the second impurities outlet.

* * * * *